US008210635B2

(12) United States Patent
Kusuhata

(10) Patent No.: US 8,210,635 B2
(45) Date of Patent: Jul. 3, 2012

(54) PRINTING APPARATUS AND PRINTING METHOD

(75) Inventor: Masahiko Kusuhata, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 12/458,170

(22) Filed: Jul. 2, 2009

(65) Prior Publication Data

US 2010/0002037 A1 Jan. 7, 2010

(30) Foreign Application Priority Data

Jul. 4, 2008 (JP) ..... P2008-176331
Jul. 1, 2009 (JP) ..... P2009-157085

(51) Int. Cl.
*B41J 29/38* (2006.01)

(52) U.S. Cl. ..... 347/16; 399/364

(58) Field of Classification Search ..... 347/16; 399/364

See application file for complete search history.

(56) References Cited

U.S. PATENT DOCUMENTS 4,638,372 A * 1/1987 Leng et al. ..... 358/296
4,748,516 A * 5/1988 Harano et al. ..... 358/296
5,104,110 A * 4/1992 Haibara ..... 271/9.02
5,214,442 A * 5/1993 Roller ..... 347/102
5,471,290 A * 11/1995 Nagayama et al. ..... 399/371
5,504,568 A * 4/1996 Saraswat et al. ..... 399/364
5,557,367 A * 9/1996 Yang et al. ..... 399/14
5,583,547 A * 12/1996 Gast et al. ..... 347/22
5,784,090 A * 7/1998 Selensky et al. ..... 347/102
6,012,792 A * 1/2000 Sievert et al. ..... 347/3
6,315,379 B1 * 11/2001 Adams et al. ..... 347/14
6,574,451 B2 * 6/2003 Miyasaka et al. ..... 399/401
7,344,326 B2 * 3/2008 Yasui et al. ..... 400/603
7,712,989 B2 * 5/2010 Yasui et al. ..... 400/635
7,748,816 B2 * 7/2010 Koase ..... 347/19
7,775,619 B2 * 8/2010 Kawabata ..... 347/16
2003/0072578 A1 * 4/2003 Boothe et al. ..... 399/44
2003/0198496 A1 * 10/2003 Miyasaka et al. ..... 399/401
2004/0165926 A1 * 8/2004 Yasui et al. ..... 400/578
2006/0087547 A1 * 4/2006 Yasui et al. ..... 347/104
2006/0209129 A1 * 9/2006 Onozawa ..... 347/55

(Continued)

FOREIGN PATENT DOCUMENTS

JP 2006256855 A * 9/2006

(Continued)

*Primary Examiner* — Charlie Peng
*Assistant Examiner* — Peter Radkowski
(74) *Attorney, Agent, or Firm* — The Nath Law Group; Jerald L. Meyer; Stanley N. Protigal

(57) ABSTRACT

A printer comprising: an image former that forms a plurality of images on a plurality of sheets; a circulation transfer route composed of a first transfer route that transfers each sheet fed from a feeding route toward a discharging route, and a second transfer route that is branched from the first transfer route and returns each sheet received from the first transfer route to the first transfer route; a printing rate detector that detects a printing rate of each image; a circulation number determiner that determines a circulation number of each sheet on the circulation transfer route based on the printing rate of each image; a scheduling coordinator that coordinates a sheet transfer schedule based on the circulation number of each sheet; and a transfer drive controller that controls quantities described in the sheet transfer schedule by controlling driving mechanisms on the circulation transfer route and switching between the first and second transfer routes based on the schedule.

12 Claims, 12 Drawing Sheets

U.S. PATENT DOCUMENTS

2006/0209153 A1* 9/2006 Nishida et al. ..... 347/104
2007/0064032 A1* 3/2007 Kawabata ..... 347/9
2007/0296751 A1* 12/2007 Ono et al. ..... 347/16
2009/0129839 A1* 5/2009 Yamazaki et al. ..... 399/400
2009/0147039 A1* 6/2009 Koase ..... 347/16
2010/0002037 A1* 1/2010 Kusuhata ..... 347/16

FOREIGN PATENT DOCUMENTS

JP 2006-264828 A 10/2006
JP 2006264828 A * 10/2006

* cited by examiner

| TRANSFER TIMING NUMBER | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| PASSED PAPER | | | | | | | | | | | | | | | | |

TRANSFER TIMING NUMBER 1

TRANSFER TIMING NUMBER 2

TRANSFER TIMING NUMBER 3

TRANSFER TIMING NUMBER 4

TRANSFER TIMING NUMBER 5

TRANSFER TIMING NUMBER 6

FIG. 8A

| TEMPORARY TRANSFER TIMING NUMBER | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| TRANSFER SPACE | 1 | 2 | 3 | 4 | 5 | 1 | 2 | 3 | 4 | 5 | 1 | 2 | 3 | 4 | 5 | 1 |
| PASSED PAPER | 6 | | | | | | | | | | | | | | | |

FIG. 8B

| TEMPORARY TRANSFER TIMING NUMBER | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| TRANSFER SPACE | 1 | 2 | 3 | 4 | 5 | 1 | 2 | 3 | 4 | 5 | 1 | 2 | 3 | 4 | 5 | 1 |
| PASSED PAPER | 6 | | | | | | | | | | | | | | | |

LAST DISCHARGED PAPER NUMBER (e.g.: 6)

FIG. 8C

| TEMPORARY TRANSFER TIMING NUMBER | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| TRANSFER SPACE | 1 | 2 | 3 | 4 | 5 | 1 | 2 | 3 | 4 | 5 | 1 | 2 | 3 | 4 | 5 | 1 |
| PASSED PAPER | 6 | | | | | 6 | | | | | 6 | | | | | 6 |

FIG. 8D

| TEMPORARY TRANSFER TIMING NUMBER | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| TRANSFER SPACE | 1 | 2 | 3 | 4 | 5 | 1 | 2 | 3 | 4 | 5 | 1 | 2 | 3 | 4 | 5 | 1 |
| PASSED PAPER | 6 | 5 | | | | 6 | 5 | | | | 6 | 5 | | | | 6 |

FIG. 8E

| TEMPORARY TRANSFER TIMING NUMBER | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| TRANSFER SPACE | 1 | 2 | 3 | 4 | 5 | 1 | 2 | 3 | 4 | 5 | 1 | 2 | 3 | 4 | 5 | 1 |
| PASSED PAPER | 6 | 5 | 4 | 3 | | 6 | 5 | | 3 | | 6 | 5 | | 3 | | 6 |

FIG. 8F

| TEMPORARY TRANSFER TIMING NUMBER | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| TRANSFER SPACE | 1 | 2 | 3 | 4 | 5 | 1 | 2 | 3 | 4 | 5 | 1 | 2 | 3 | 4 | 5 | 1 |
| PASSED PAPER | 6 | 5 | 4 | 3 | 2 | 6 | 5 | 1 | 3 | | 6 | 5 | | 3 | | 6 |

FIG. 8G

| TEMPORARY TRANSFER TIMING NUMBER | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| TRUE TRANSFER TIMING NUMBER | 16 | 15 | 14 | 13 | 12 | 11 | 10 | 9 | 8 | 7 | 6 | 5 | 4 | 3 | 2 | 1 |
| TRANSFER SPACE | 1 | 5 | 4 | 3 | 2 | 1 | 5 | 4 | 3 | 2 | 1 | 5 | 4 | 3 | 2 | 1 |
| PASSED PAPER | 6 | 5 | 4 | 3 | 2 | 6 | 5 | 1 | 3 | | 6 | 5 | | 3 | | 6 |

PRINTING APPARATUS AND PRINTING METHOD

BACKGROUND OF THE INVENTION

1. Field of the Invention

The present invention relates to printing apparatuses to form images on sheets transferred on a transfer route. In particular, the present invention relates to a printing apparatus having a decurl function to prevent printed sheets from curling and relates to a printing method of the printing apparatus.

2. Description of Related Art

In a printing apparatus such as an inkjet printer, printed sheets are curled The reason is because a printed side of each sheet becomes wet by adhesion of water-based ink used in the printing apparatus. However, sheet curling is gradually lessened since ink on the sheets is dried as time passes. Thus, there has been proposed a method to decurl the printed sheets without immediately discharging the printed sheets, and to discharge the printed sheets after the dryness of ink.

As a conventional method to secure time to dry ink, Japanese Patent Laid-Open Publication No. 2006-264828 discloses a method to circulate printed sheets on a circulation transfer route in a printer. The method determines a circulation number of the printed sheets according to printing conditions and circulates the printed sheets the determined number of times.

SUMMARY OF THE INVENTION

In the above-mentioned method, however, when a print target is composed of a plurality of documents, if only a sheet printed with one of the documents is circulated more times than them with the other documents, the discharging order of the printed sheets is inconsistent with them of the other printed sheets as a whole. Therefore, in order mat the feeding order of sheets and the discharging order of the sheets correspond with each other, based on a document assigned with the largest number of circulation, every document is circulated the largest number of times. If the documents are printed on the sheets different circulation numbers of times, the times during transferring the sheets from feeding to discharging are different from each document. Thus, even if the sheets are fed in a scheduled order of discharging, if the sheets are discharged in the order of finishing decurling, the actually discharging order differs from the scheduled order. Therefore, in the above-mentioned method, every printed sheet is uniformly decurled with the largest number of circulation based on the document having the largest number of circulation.

Consequently, the above-mentioned method takes much time to print all the documents since the total circulation number of the sheets printed with the documents increases.

The present invention has been made to solve the above-mentioned issue. The present invention has an object to provide a printing apparatus, such as an inkjet printer, and printing method possible to minimize the total circulation number of printed sheets to decurl the printed sheets on a circulation transfer route, avoid the total printing time taking longer, and maintain the productivity of printing by determining the circulation number of each document according to printing rate.

To achieve the above-described object, a first aspect of the present invention provides a printing apparatus comprising: an image former that forms a plurality of images on a plurality of sheets; a circulation transfer route composed of a first transfer route that transfers each sheet fed from a sheet feeding route toward a sheet discharging route, and a second transfer route that is branched from the first transfer route and returns each sheet received from the first transfer route to the first transfer route; a printing rate detector that analyzes an ejecting amount of ink or a concentration of ink necessary to form each image on each sheet by the image former on the first transfer route and detects a printing rate of each image; a circulation number determiner that determines a circulation number of each sheet on the circulation transfer route based on the printing rate of each image; a scheduling coordinator that coordinates a sheet transfer schedule describing a forming speed of each image, a transfer speed of each sheet, a transfer order of each sheet, a feed timing of each sheet, a transfer timing of each sheet, and a discharge timing of each sheet, based on the circulation number of each sheet; and a transfer drive controller that controls the forming speed of each image, the transfer speed of each sheet, the transfer order of each sheet, the feed timing of each sheet, the transfer timing of each sheet, and the discharge timing of each sheet, by controlling driving mechanisms provided on the circulation transfer route and switching between the first transfer route and the second transfer route based on the sheet transfer schedule.

A second aspect of the present invention provides a printing method comprising: preparing a printing apparatus that includes a circulation transfer route composed of a first transfer route that transfers each sheet fed from a sheet feeding route route that is branched from the first transfer route and returns each sheet received from the first transfer route to the first transfer route, and a image former that forms a plurality of images on a plurality of sheets; analyzing an ejecting amount of ink or a concentration of ink necessary to form each image on each sheet by the image former on the first transfer route and detecting a printing rate of each image; determining a circulation number of each sheet on the circulation transfer route based on the printing rate of each image; coordinating a sheet transfer schedule describing a forming speed of each image, a transfer speed of each sheet, a transfer order of each sheet, a feed timing of each sheet, a transfer timing of each sheet, and a discharge timing of each sheet, based on the circulation number of each sheet; and controlling the forming speed of each image, the transfer speed of each sheet, die transfer order of each sheet, the feed timing of each sheet, the transfer timing of each sheet, and the discharge timing of each sheet, by controlling driving mechanisms provided on the circulation transfer route and switching between the first transfer route and the second transfer route based on the sheet transfer schedule.

BRIEF DESCRIPTION OF THE DRAWINGS

FIG. 6 is a view showing an example of a sheet transfer schedule at decurling in the printing apparatus shown in FIG. 1.

FIGS. 8A to 8G are views showing an example of coordination process of a sheet transfer schedule in the printing apparatus shown in FIG. 1.

DETAILED DESCRIPTION OF PREFERRED EMBODIMENTS

There will be described below embodiments of the present invention with reference to FIG. 1 to FIG. 11.

(Whole Structure of Printing Apparatus)

Figure 1:
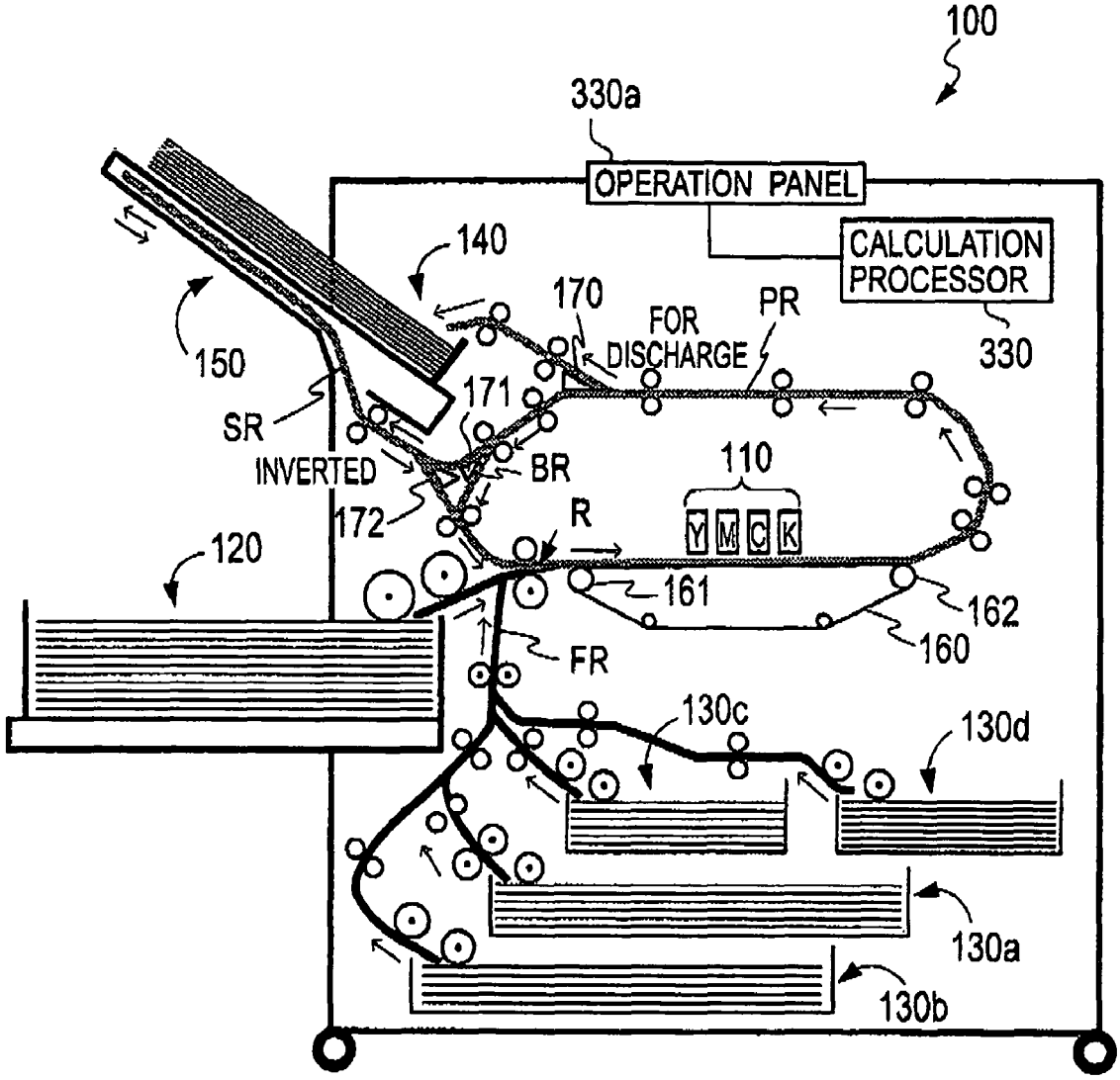
FIG. 1 is a view showing a schematic structure of a printing apparatus according to an embodiment of the present invention.

FIG. 1 is a view showing a schematic picture of a printing apparatus 100 according to the present embodiment.

As shown in FIG. 1, a sheet transfer route in the present embodiment includes: a system of feeding routes "FR" to feed sheets; a sheet discharging route "DR" to discharge the sheets, a normal transfer route (first transfer route) "PR" to transfer the sheets from the system of feeding routes FR to the sheet discharging route DR; a bypass route "BR" that is branched from the normal transfer route PR and directly returns the sheets received from the normal transfer route PR to the normal transfer route PR; and an inversion route (switch back route) "SR" that is branched from the normal transfer route PR and inverts the both sides of the sheets received from the normal transfer route PR to return the sheets to the normal transfer route PR. Note that the bypass route BR or the inversion route SR is called below a "connecting route (second transfer route)", and a circular route composed of the normal transfer route (first transfer route) PR and the connecting route (second transfer route) is called below a "circulating transfer route "CR"".

The printing apparatus 100 includes a side sheet feeding table 120 protruded from a side surface of a casing, and a plurality of sheet feeding trays 130 (130*a*, 130*b*, 130*c*, 130*d*) provided in the casing, as a sheet feeding mechanism for feeding sheets to the normal transfer route PR. The printing apparatus 100 also includes a discharging port 140 as a sheet discharging mechanism for discharging printed sheets (one-side or both-side printed sheets).

The printing apparatus 100 includes a printing head unit (image former) 110 having four ink heads of black (K), yellow (Y), magenta (M), and cyan (C), each of which is provided with multiple nozzles along a sheet width direction. The printing apparatus 100 is an inkjet line color printer that prints per line by ejecting black or colored ink from each ink head on a sheet and that forms a plurality of images on the sheet on a transfer belt 160 so mat the images are mutually overlapped on the sheet.

The sheets fed from the sheet feeder of any one of the side sheet feeding table 120 and the sheet feeding trays 130 are transferred on the system of feeding routes FR in the casing by means of driving mechanisms such as a roller, and introduced to a resister "R" for positioning a front edge of the sheets and adjusting a sheet inclination. The printing head unit 110 is provided downstream of the resister R. The images are formed on the sheets per line with ink ejected from each ink head while being transferred by the transfer belt 160 that faces the ink ejecting surface of the printing head unit 110 at a speed determined by printing conditions.

The printed sheets are further transferred in the casing by driving mechanisms such as a roller. When one-side printing is instructed in a print job, the printed sheets are directly introduced to the discharging port 140 and pulled up with the printed side down on a output tray 150 provided as a receiving tray of the discharging port 140. The output tray 150 is protruded from the casing having a certain thickness. Since the output tray 150 is inclined to a side wall of the casing, the sheets discharged from the discharging port 140 are naturally piled up along the inclination of the output tray 150.

When both-side printing is instructed in a print job, the printed sheets are further transferred in the casing without being introduced to the discharging port 140 after printing on front sides (hereinafter call a first printing side "front side", and a second printing side "reverse side"). Thus, the printing apparatus 100 includes switching mechanisms 170, 171 and 172 to switch the transfer route to print on reverse sides.

The switching mechanism 170 is switching means for selectively connecting the inversion route SR branched from the normal transfer route PR and the sheet discharging route DR to the normal transfer route PR. Thus, the switching mechanism 170 introduces the sheets being transferred on the normal transfer route PR to the inversion route SR or the sheet discharging route DR. When being not discharged by the switching control of the switching feature 170, the sheets are introduced into the inversion route SR, inverted in the inversion route SR, and returned to the normal transfer route PR.

Moreover, the bypass route BR is provided downstream of the switching mechanism 170 so that the sheets are selectively introduced to the inversion route SR or the bypass route BR from the normal transfer route PR by means of the switching mechanism 171. On the bypass route BR, the sheets are directly transferred to the normal transfer route PR without being inverted. By being transferred via the bypass route BR, the sheets can be circulated through the printing head unit 110 several times with the front sides up. While, on the inversion route SR, the sheets are inverted on the inversion route SR and returned to the normal transfer route PR by means of the switching feature 172.

The sheets passing through either the inversion route SR or the bypass route BR by driving mechanisms such as a roller are introduced to the resister R again, and printed on the reverse sides in the same steps as printed on the front sides. The sheers with images formed on both sides after printing on the reverse sides are introduced to the discharging port 140 and piled up on the output tray 150 provided as a receiving tray of the discharging port 140.

According to the present embodiment, the switch back process at both-side printing is performed by use of space provided within the output tray 150. The space is covered so that the sheets are not picked up during the switch back process. Therefore, it is possible to prevent the sheets during the switch back process from being accidentally taken away by a user. Further, since the output tray 150 is fundamentally provided in the printing apparatus 100, it is not necessary to provide the printing apparatus 100 with extra space for the switch back process. Thus, it is possible to avoid the size of the casing being increased. Furthermore, since the discharging port 140 and the inversion route SR are used separately, it is possible to perform the switch back process for a sheet and the discharging process for another sheet simultaneously.

In the printing apparatus 100, the sheets printed on the front side in both-side printing are also transferred to the resister R that specifies a reference position of the front edges of the sheets fed from the system of feeding routes FD. Thus, there is a junction just in a front position of the resister R at which the route that the fed sheets are transferred and the route that the sheets printed on the front side are transferred are jointed together.

Figure 2:
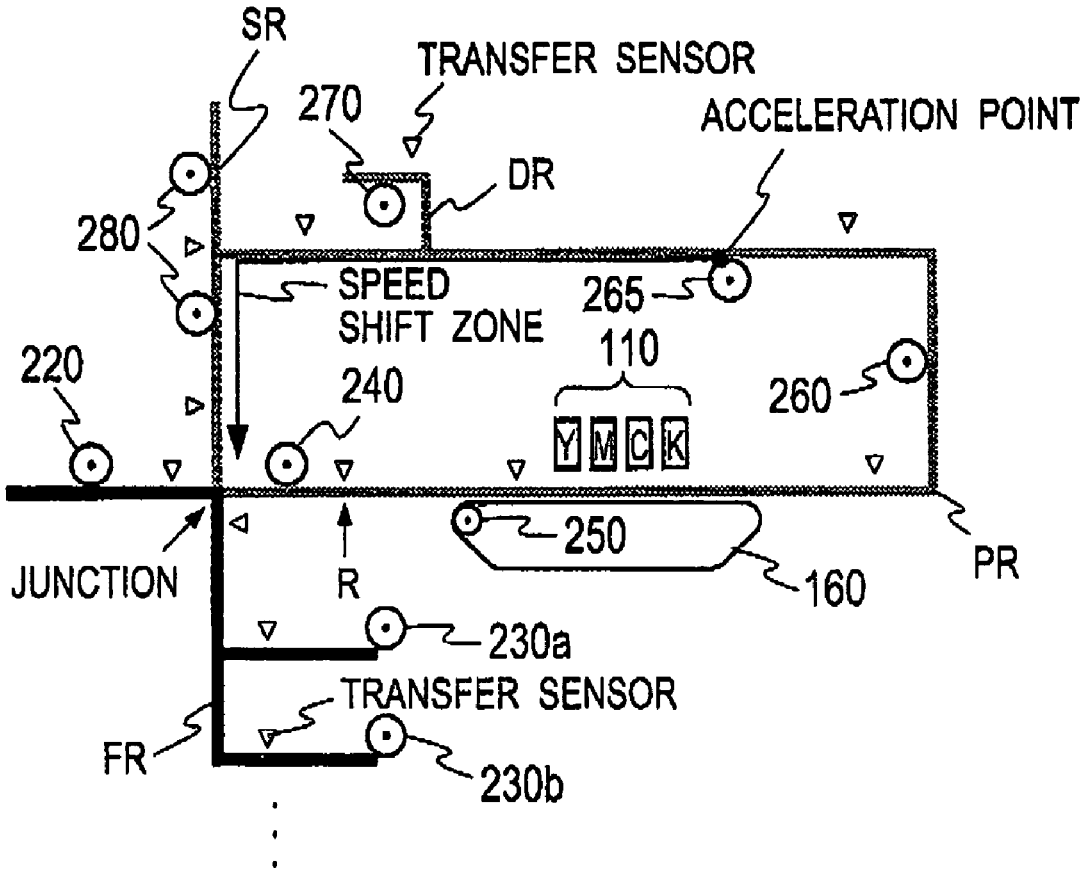
FIG. 2 is a view showing a sheet transfer route of the printing apparatus shown in FIG. 1.

FIG. 2 is a view showing a sheet transfer route including the system of feeding routes FR, the normal transfer route PR, and the inversion route SR. Note that in the figure the number of rollers constituting drivers is arbitrarily abbreviated for convenience.

The system of feeding routes FR is provided with a side sheet feeding driver 220 to feed sheets from the side sheet feeding table 120, and a tray 1 driver 230*a*, array 2 driver 230*b*, . . . to feed the sheets from the sheet feeding trays 130 (130*a*, 130*b*, . . . ). Every driver includes a driving mechanism composed of a plurality of rollers to receive the sheets one by one placed on the side sheet feeding table 120 or the sheet feeding trays 130 and transfer the sheets to the resister R. Each driver can be driven individually, and appropriately perform an operation according to the corresponding sheet feeding mechanism to feed the sheets.

In addition, the system of feeding routes FR is provided with a plurality of transfer sensors so as to detect a transfer jam (sheet feeding error) in the system of feeding routes FR. Each transfer sensor detects the presence of the sheets or the front edges of the sheets. For instance, the transfer jam can be detected by the plurality of the transfer sensors provided on the system of feeding routes FR with given intervals when a transfer sensor detect no sheet within a predetermined time after another transfer sensor placed on the upstream side detect sheets.

Moreover, the transfer jam can be detected by a plurality of transfer sensors provided around the sheet feeding ports of the side sheet feeding table 120 and the sheet feeding trays 130 when the transfer sensors detect no sheet within a predetermined time after the side sheet feeding driver 220, the tray 1 driver 230*a* (and other drivers) are driven. By providing the respective transfer sensors around each sheet feeding port, it can be determined not only whether the transfer jam is being occurred in the system of feeding routes FR, but also where the transfer jam is being occurred in the system of feeding routes FR.

As mentioned above, in the present embodiment, both of the sheets to be printed on both sides and the sheets necessary to be decurled are transferred to the normal transfer route PR via the inversion route SR or the bypass route BR so that the sheets are circulated passing through the printing head unit 110 repeatedly.

Specifically, the normal transfer route PR includes: a resister driver 240 to introduce sheets to the resister R; a belt driver 250 to circularly activate the transfer belt 160 facing the ink ejecting surface of the printing head unit 110; a first transfer driver 260 and a second transfer driver 265 sequentially provided from upstream to downstream in the sheet transfer direction; a discharging driver 270 to introduce the printed sheets to the discharging port 140; and an inversion route driver 280 to introduce the sheets to be printed on the reverse side into the inversion route SR to invert and then introduce to the junction. The drivers 240, 250, 260, 265, 270 and 280 include driving mechanisms composed of one roller or a plurality of rollers to transfer sheets one by one in the transfer route. Each driver can be driven individually and appropriately activate according to sheet transferring conditions.

The normal transfer route PR is also provided with a plurality of transfer sensors to detect a transfer jam in the normal transfer route PR. In addition, it is possible to confirm in the resister R whether the sheets are being transferred appropriately. Each driver is provided with the transfer sensors respectively in the normal transfer route PR so as to specify the driver that the transfer jam is occurred.

The inversion route SR is a route that is branched from the normal transfer route PR to invert the sheets received from the normal transfer route PR so as to turn the sheets upside down and return to the normal transfer route PR. The inversion route SR can transfer the sheets with a different speed from the normal transfer route PR. In addition, it is possible to gain and reduce speed when the inversion route SR receives the sheets from the normal transfer route PR, and possible to extend and shorten the suspension during the switch back.

In the present embodiment, it is possible to continue feeding a new sheet and printing with predetermined intervals before a preceding sheet is discharged depending on a sheet transfer schedule, instead of waiting until the printing and discharging of the preceding sheet have been completed.

Figure 5A:
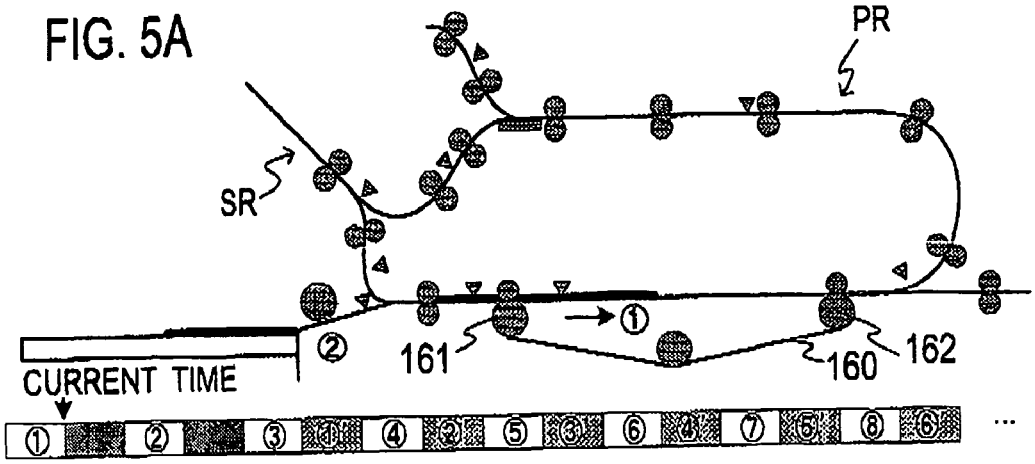
FIGS. 5A to 5C are views showing an outline of sheet transfer in the printing apparatus shown in FIG. 1.
Figure 5B:
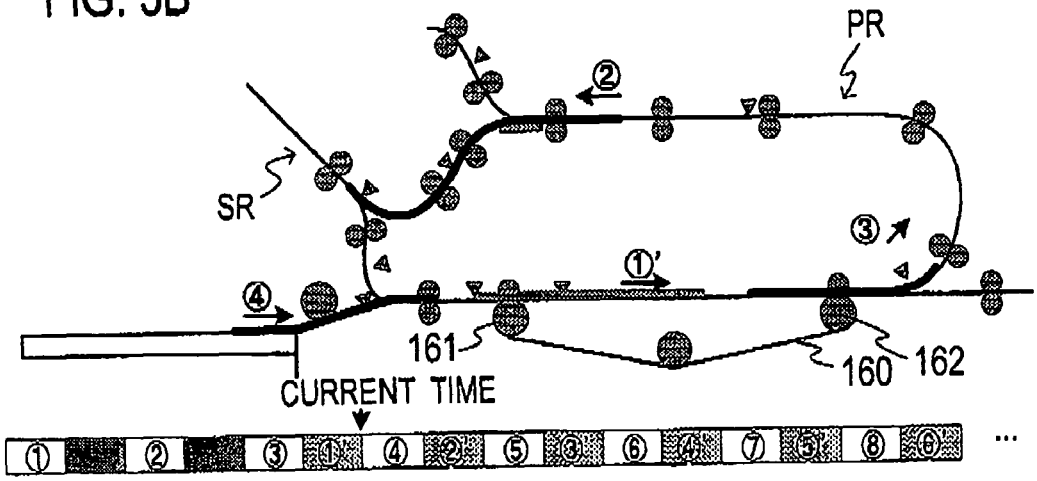
Figure 5C:
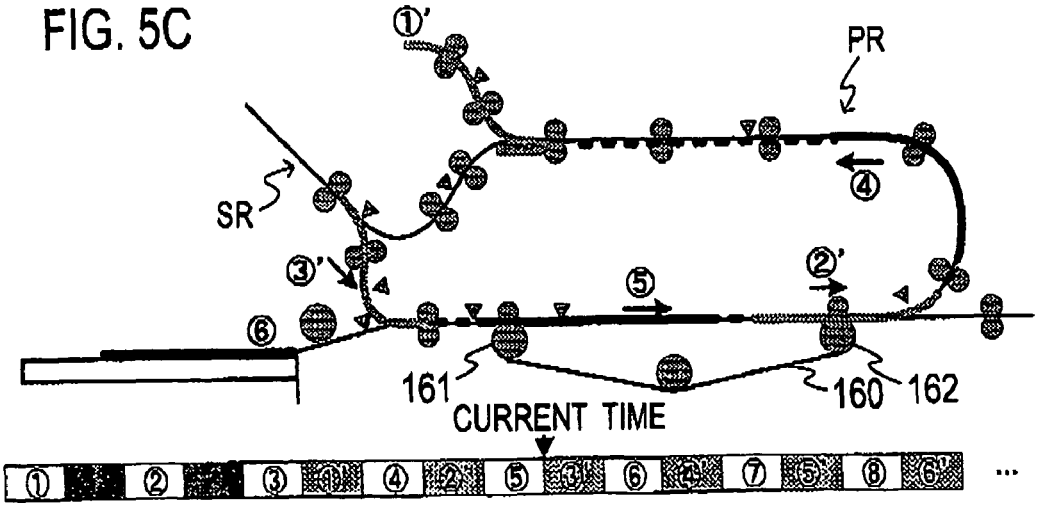

In regular both-side printing in the printing apparatus 100, as shown in FIGS. 5A to 5C, after a sheet is printed on the front side at the printing head unit 110 (FIG. 5A), the sheet is circulated on the normal transfer route PR, inverted via the inversion route SR, returned to the printing head unit 110 again (FIG. 5B), and discharged after being printed on the reverse side (FIG. 5C). In this case, the sheet (1') inverted via the inversion route SR is inserted between the sheets (3) and (4) to be printed on the front side (FIG. 5B).

Therefore, in a regular sheet transfer schedule of both-side printing, when sheets are fed from the sheet feeding port of the side sheet feeding table 120 or the sheet feeding trays 130, intervals are provided on the normal transfer route PR in advance so as to reserve space to insert a sheet returned from the inversion route SR. Thus, in the printing apparatus 100, it is possible to perform the front side printing and the reverse side printing simultaneously and achieve a printing productivity of half the time it performs one-side printing.

The transfer belt 160 is hitched to a driving roller 161 and a driven roller 162 provided upstream and downstream in the transfer direction in both end portions of the transfer belt 160. The transfer belt 160 is circularly run on the both rollers in a clockwise direction in the figure. In addition, multiple fine through-holes may be provided on the transfer belt 160 to stick sheets on the transfer belt 160 by applying negative pressure to the through-holes of the transfer belt 160 so as to promote the decurl effect.

On the transfer belt 160, there are provided with the four ink heads of yellow (Y), magenta (M), cyan (C) and black (B), which make up the printing head unit 100, along the sheet transfer direction in this order.

(Calculation Processor)

As shown in FIG. 1, the printing apparatus 100 includes a calculation processor 330. The calculation processor 330 is a calculation module that is composed of hardware such as a processor including CPU and DSP (Digital Signal Processor), memory and other electronic circuits, software such as a program including the above-mentioned functions, or a combination of those. The calculation processor 330 virtually assembles a variety of functional modules by reading and executing programs appropriately, and executes image data processing, performance control of each component, and a variety of processes with respect to user operations. In addition, the calculation processor 330 is connected to an operation panel 330*a* to accept commands and setting operations by a user via the operation panel 330*a*.

The printing apparatus 100 includes a function to dry sheets printed with a plurality of documents to decurl by circulating each printed sheet a predetermined number of times depending on a printing rate of each document via the inversion route SR or bypass route BR. In the present embodiment, decurling at one-side printing is performed by circulating printed sheets via the bypass route BR a predetermined number of times after one-side printing. Also, decurling at both-side printing is performed by printing on the reverse side of one-side printed sheets via the inversion route SR, arranging the sheets in the discharging order of the sheets via the inversion route SR if necessary, and circulating the sheets via the bypass route BR from the subsequent circulation to decurl, followed by discharging the sheets.

(Decurl Process Control)

Figure 3:
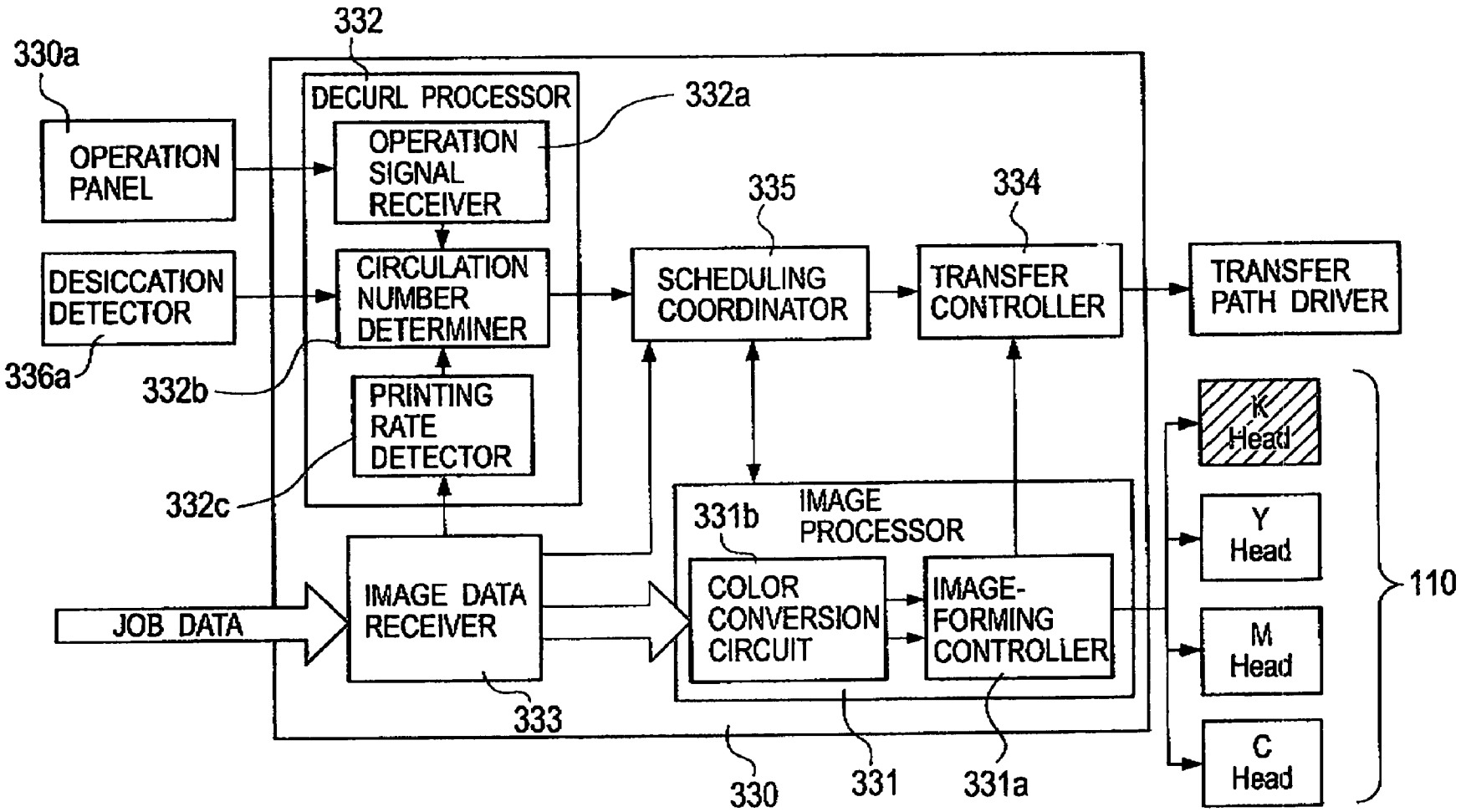
FIG. 3 is a block diagram showing functional modules of a calculation processor of the printing apparatus shown in FIG. 1.

The decurl processing in the present embodiment is executed in the calculation processor 330 by analyzing image data, and controlling performance of the head unit 110 and a transfer route driver (FIG. 3) such as the driving motor and switching mechanism mentioned above. FIG. 3 is a block diagram showing functional modules of the calculation processor 330.

As shown in FIG. 3, the calculation processor 330 includes an image processor 331, a decurl processor 332, an image data receiver 333, a transfer controller 334, and a scheduling coordinator 335.

The image data receiver 333 is a communication interface to receive job data, and a module to transfer image data included in the received job data to the image processor 331, the decurl processor 332, and the scheduling coordinator 335.

The image processor 331 is a calculation processing device to execute digital signal processing specialized in image processing, and a module to convert image data necessary for printing and execute image-forming processing. The image processor 331 includes an image-forming controller 331*a* and a color conversion circuit 331*b*.

The color conversion circuit 331*b* is a circuit to convert RGB print images to CMYK print images, and directs the image-forming controller 331*a* to print based on the respective print images in each color. The image-forming controller 331*a* is a module to control performances of each color ink head and the driving mechanisms on the transfer route so as to control image-forming processing as a whole. The image-forming controller 331*a* forms the images with timing and printing speed coordinated by the scheduling coordinator 335.

The decurl processor 332 includes an operation signal receiver 332*a*, a circulation number determiner 332*b*, and a printing rate detector 332*c*.

The operation signal receiver 332*a* is a module to receive operation signals by a user from the operation panel 330*a*, and analyzes the received operation signals and directs the other modules to perform processes according to user operations. In particular, in the present embodiment, the operation signal receiver 332*a* has a function to receive command operations and setting operations whether a user executes decurl processing or not in order to prevent sheets from curling at image forming, and a function to output the judgment of necessity to decurl processing to the circulation number determiner 332*b*. When the operation signal receiver 332*a* is configured not to execute decurl processing, (he circulation number determiner 332*b* automatically outputs usual circulation numbers without adding the circulation numbers for decurling.

The printing rate detector 332*c* is a module to calculate printing rates of a plurality of documents as a print target on a plurality of sheets. The printing rate detector 332*c* analyzes an image property including any one of the ejecting amount of ink and the concentration of ink in image-forming processing, detects the printing rate, printing distribution, and others for each ink, and outputs the detection result according to image data included in job data received by the image data receiver 333. When there are a plurality of documents in one printing job, the printing rate detector 332*c* develops all the documents as a plurality of image data. Moreover, the printing rate detector 332*c* assigns each image data to each of the front and reverse sides when both-side printing is instructed in the printing job, selects all documents possible to be curled, and outputs the image property of the selected documents to the circulation number determiner 332*b*. With regard to the calculation of printing rates, it may be determined based on data in the highest printing rate area or the worst printing condition area by dividing the image data of each document into several areas.

The circulation number determiner 332*b* is a module to estimate curling of a sheet on which each document is to be printed according to the printing rate of each document and determine the circulation number of each document. The determined circulation numbers are input into the scheduling coordinator 335. The circulation number determiner 332*b* obtains information about the image properties such as a printing rate from the printing rate detector 332*c* with regard to each of the front and reverse sides of each document, compares each printing rate with a threshold value, and presumes the occurrence of curling when the printing rate of each document is above the threshold value. Then, the circulation numbers determined based on the presumption is output into the scheduling coordinator 335.

Moreover, the circulation number determiner 332*b* calculates the circulation numbers of both the front and reverse sides of each document according to the printing rate of each side, and determines which side has the larger circulation number. Then, the circulation number of a sheet for printing the document is calculated depending on the side with the larger circulation number.

In the present embodiment, the circulation number determiner 332*b* is connected to a desiccation detector 336*a* to detect a drying condition of sheets in the sheet transfer route. The desiccation detector 336*a* has a function to change the determined circulation numbers when the sheets are dried before completing the predetermined circulation numbers and to reschedule the subsequent processes (such as sheet feeding process and sheet discharging process). As the desiccation detector 336*a*, a variety of means such as a moisture sensor and a transmittance sensor possible to estimate moisture content on sheets can be employed.

The circulation number determiner 332*b* may be connected to a temperature or moisture sensor, for example, to measure temperature or moisture around the transfer route. In addition, the threshold value may be altered according to the temperature or moisture obtained by the sensor.

The transfer controller 334 is a module to control the transfer of sheets on the normal transfer route PR and the inversion route SR and the operations of the switching mechanism 170 according to a sheet transfer schedule coordinated by the scheduling coordinator 335. The transfer controller 334 controls sheet discharging to introduce the sheets on the normal transfer route PR to the sheet discharging route DR according to the circulation numbers determined by the circulation number determiner 332*b*, and controls sheet feeding to feed the sheets into the resister R in printing order according to the transfer intervals of the sheets. In the sheet discharging control according to the present embodiment, the consistency of the discharging order of the sheets, the circulation numbers of the sheets, and the front and reverse sides of the sheets are determined when the sheets on the normal transfer route PR are arrived at a switching point of the sheet discharging route DR and the inversion route SR. Based on the determination, switching between the inversion route SR and the sheet discharging route DR is controlled.

(Scheduling Coordination)

The scheduling coordinator 335 is a module to determine feed timing and discharge timing of sheets to be printed on the front side, feed timing and discharge timing of inverted sheets via tie inversion route SR, an image-forming speed, a sheet transfer speed, a sheet transfer order, and transfer timing of sheets so as to coordinate a sheet transfer schedule. The scheduling coordinator 335 coordinates the sheet transfer schedule according to the circulation numbers determined by the circulation number determiner 332*b*.

Figure 6A:
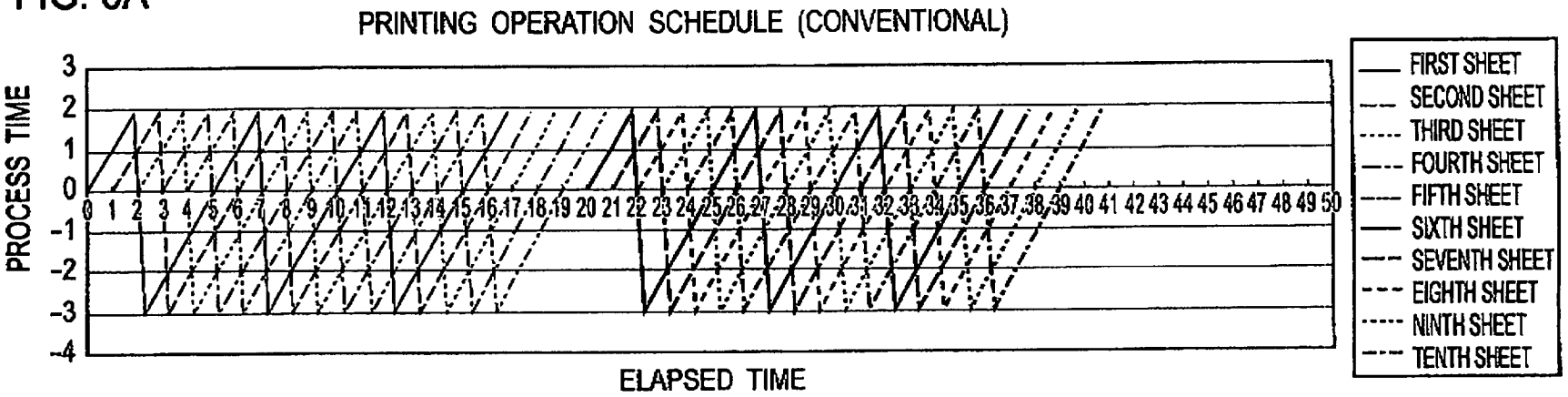
FIG. 6A is a conventional sheet transfer schedule and FIG. 6B is a sheet transfer schedule according to an embodiment of the present invention.
Figure 6B:
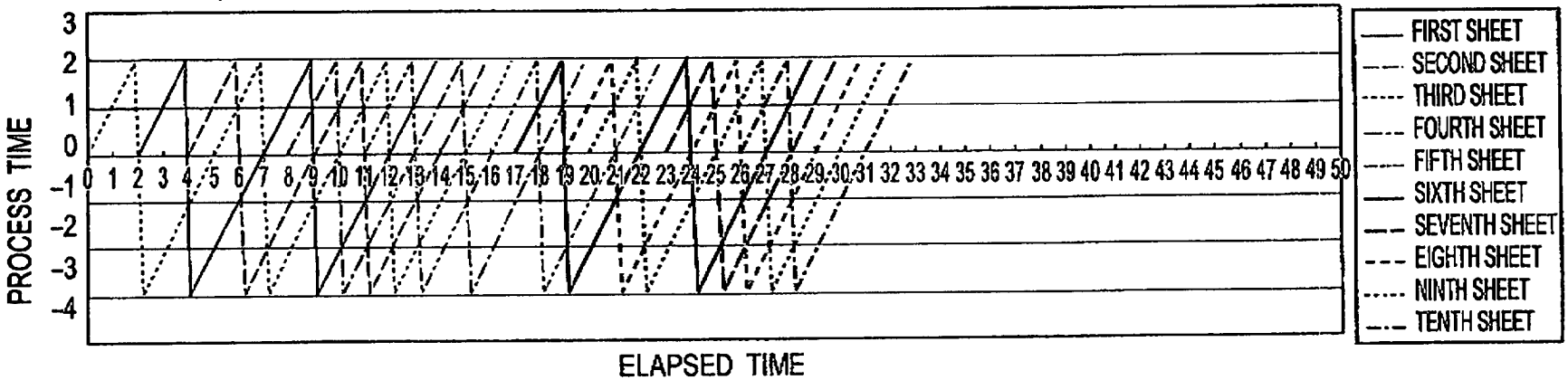

FIG. 6 shows an example of a sheet transfer schedule for sheets transferred on the sheet transfer route in the printing apparatus 100. FIG. 6A is a conventional sheet transfer schedule and FIG. 6B is a sheet transfer schedule according to an embodiment of the present invention.

In FIGS. 6A and 6B, the lateral axis represents an elapsed time, and the vertical axis represents a process time. In particular, regarding the vertical axis, the value "0" represents a sheet feeding process, the values "0" to "2" represent processes between the normal transfer route PR and a point in a front position of the sheet discharging route DR, and the value "1" represents a printing process. In the process "1", sheets during decurling are simply transferred without printing. In the normal mode, the sheets are discharged in the process "2". In both-side printing, the sheets are not discharged in the process "2(=−3)", but returned to the resister R of the process "0" via the inversion route SR or the bypass route BR, circulated predetermined times on the normal transfer route PR, and discharged in the process "2".

In the present embodiment, the scheduling coordinator 335 coordinates a sheet transfer schedule based on the feed timing of each sheet obtained by subtracting the circulation time required for each sheet to circulate on the circulation transfer route CR with the circulation number determined for each document by the circulation number determiner 332*b* from the discharge timing of each sheet FIGS. 7 to 9 show typical examples of coordination of a sheet transfer schedule by the scheduling coordinator 335.

Figure 7A:
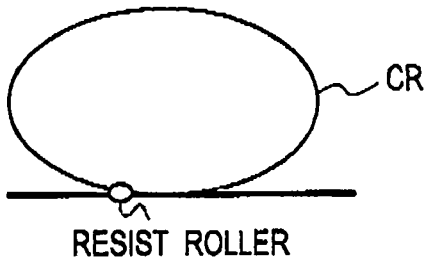
FIGS. 7A to 7G are views showing a relationship between transfer spaces and transfer timings in the printing apparatus shown in FIG. 1.

First as shown in FIG. 7A, an interval between adjacent sheets transferred on the circulation transfer route CR is calculated so as to reserve transfer spaces to feed sheets on the circulation transfer route CR. Next, the length of the circulation transfer route CR is divided by the calculated interval to calculate the number of sheets possible to be circulated in the circulation transfer route CR. Then, the time obtained by dividing a circulation time of a sheet by the number of sheets possible to be circulated on the circulation transfer route CR is defined as a unit time to determine the transfer timing of the sheets. Note that in FIG. 7A the "passed sheet" represents a sheet that passes through the resist roller and the "transfer timing number" represents a number showing transfer timing of each sheet.

Figure 7B:
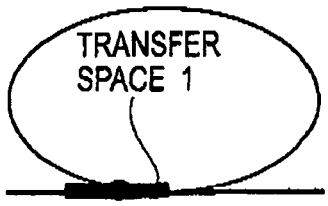
Figure 7C:
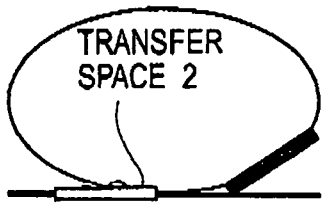
Figure 7D:
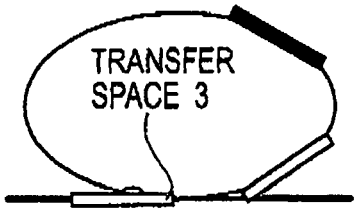
Figure 7E:
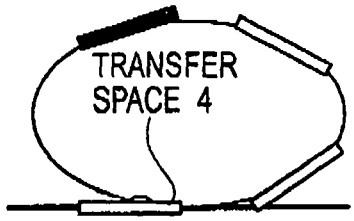
Figure 7F:
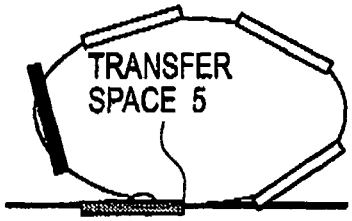
Figure 7G:
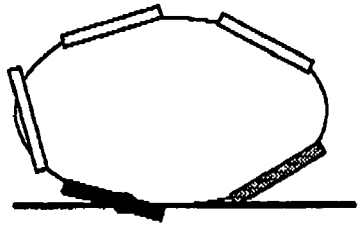

Here, as shown in FIGS. 7B to 7G, since the number of sheets possible to be circulated on the circulation transfer route CR is determined up to five, the circulation cycle has five units of time. In FIGS. 7B to 7F, the transfer spaces are numbered from "1" to "5" corresponding to the number of sheets possible to be circulated. In FIG. 7B, the transfer timing number at feeding a new sheet is defined as "1". As shown in FIGS. 7C to 7F, the transfer timing number is increased from "2" to "5" as the number of sheets to be fed according to the sheet circulation. Then, the transfer timing number is returned to the original transfer timing number "1" at the fifth units of time as shown in FIG. 7G.

In the present embodiment, the transfer controller 334 controls the driving mechanisms on the sheet transfer route so as to conform ϵ circulation time of a sheet fed from the system of feeding routes FR to a recirculation time of a sheet received from the circulation route CR. Therefore, a unit time of the newly fed sheet and a unit time of the circulating sheet are dealt with equally.

As illustrated in FIGS. 8A to 8F, transfer timing numbers (temporary transfer timing numbers) are temporarily set in ascending order at first as a sequence of natural numbers with respect to a unit time determining the transfer timing of sheets as a measure. Also, the passed sheets are periodically numbered in ascending order from the sheet to be first discharged (that is, in descending order from the sheet to be last discharged) with the number of sheets possible to be circulated as one cycle. In the present embodiment, it is assumed that the number of the passed sheets is determined up to five and there are five sheets in total on the circulation route CR (that is, the number of transfer spaces is determined up to five).

Next, each of the transfer spaces "1" to "5" is assigned with the passed sheets "1" to "6", respectively, and the time that the transfer spaces "1" to "5" are occupied by the passed sheets is scheduled. In particular, as shown in FIGS. 8B to 8D, each of the transfer spaces "1" to "5" is assigned with the passed sheets "1" to "6" respectively in descending order from the larger number with the respective circulation numbers determined for each document by the circulation number determiner 332*b*. In FIGS. 8A to 8D, it is assumed that the passed sheet "6" is required to decurl with three circulations, the passed sheets "5" and "3" are required to decurl with two circulations, and the other passed sheets are not required to decurl.

Then, as shown in FIGS. 8E and 8F, the empty transfer spaces between the already assigned transfer spaces are also assigned with the rest numbers of the passed sheets in descending order from the larger number. In other words, the empty transfer spaces are searched sequentially by skipping the already assigned transfer spaces, and then the searched transfer spaces are assigned with the rest numbers of the passed sheets. In this case, the passed sheets "1", "2" and "4" are not required to decurl. Thus, each of the passed sheets "1", "2" and "4" is assigned with the unit time as the transfer timing number.

After the assignment of the temporary transfer timing numbers is completed with respect to all the passed sheets (FIG. 8F), the temporary transfer timing numbers (and the transfer space numbers) are renumbered in the reverse order (FIG. 8G). In the present embodiment, the renumbered transfer timing numbers are defined as "true transfer timing numbers". However, for the sake of shorthand, they will hereinafter called merely "transfer timing numbers". Then, the largest transfer timing number is defined as discharge timing of each passed sheet, and the smallest transfer timing number is defined as feed timing of each passed sheet in the transfer timing numbers renumbered with respect to each passed sheet. Note here that the numbers assigned to the transfer spaces are merely dummy numbers and therefore the renumbering of the transfer spaces described above is not necessarily needed. However, if assigning the common number "1" to the starting number of the true transfer timing numbers and transfer spaces, we have a merit to easily understand the sheet transfer schedule. Thus, this is employed in the following descriptions.

In FIG. 8G the passed sheet "6" is fed at the transfer timing number "1" first. After the sheet feeding is paused for the unit time at the transfer timing number "2", the passed sheet "3" is fed at the transfer timing number "3". After the sheet feeding is paused for the unit time at the transfer timing number "4", the passed sheet "5" is fed at the transfer timing number "5". Since the transfer space "1" is occupied by the passed sheet "6" at the transfer timing number "6", this transfer timing is skipped After that, the sheet feeding is paused for the unit time at transfer timing number "7". Since the transfer space "3" is occupied by the passed sheet "3" at the transfer timing number "8", this timing is skipped. After that the passed sheet "1" is fed at the transfer timing number "9". In FIG. 8G, the passed sheet "1" fed afterward and unnecessary to decurl is immediately discharged while the passed sheets "6", "3", and "5" fed in advance are being circulated, followed by discharging the other passed sheets in a predetermined order.

(Operations in Decurl Process)

Figure 4A:
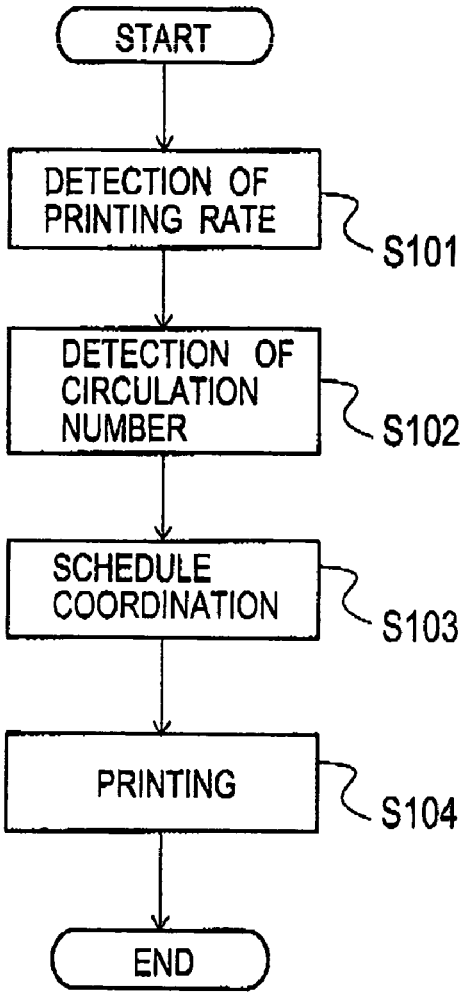
FIG. 4A is a flow chart showing the whole printing process in the apparatus shown in FIG. 1.
Figure 4B:
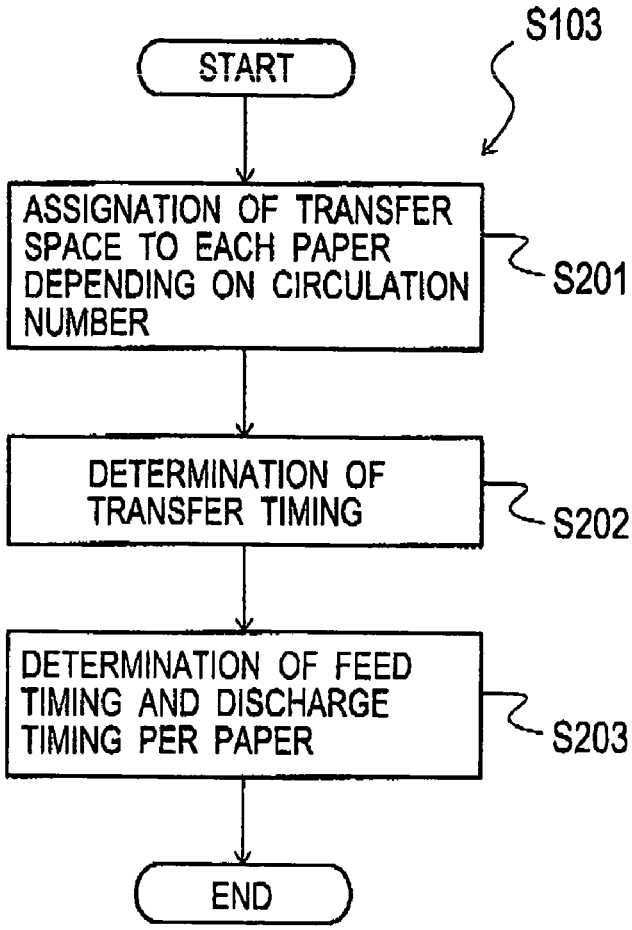
FIG. 4B is a flow chart showing coordination process of a sheet transfer schedule.

With the above-mentioned configuration, the printing apparatus 100 executes decurl processing as follows. FIG. 4A is a flow chart showing the whole printing process of the printing apparatus 100 and FIG. 4B is a flow chart showing a coordination process of the sheet transfer schedule in the printing apparatus 100.

As shown in FIG. 4A, when the image data receiver 333 receives job data including image data and the like, the image processor 331 develops the image data and the color conversion circuit 331*b* performs a color conversion for the image data. Also, the printing rate detector 332*c* detects the printing rates of the print images (S101). Then, the printing rates of the print images are evaluated step by step whether each of the printing rates is over the threshold value, and the circulation numbers of sheets are determined according to the printing rates, respectively (S102). The threshold value is appropriately altered according to the degree of sheet dryness (based on moisture and transmittance) obtained by the desiccation detector 336*a*.

In the determination process of the circulation numbers in the step S102, a control condition of the sheet printing process is determined based on the specific conditions for printing with the straight discharge or the inversion discharge, and with the printing sides up or down.

As a result, the control condition of the sheet discharging process according to the present embodiment is specifically focused on monitoring the following conditions:

Is printing on the front side completed?

Is printing on the reverse side completed?

Is the sheet dried (Has the sheet been circulated predetermined times)?

How many times is the sheet being circulated?

The following tables show several examples of the control condition. In the tables, it is assumed that when a sheet passes through the printing head unit 110 before being discharged, a side of the sheet opposed to the ink ejecting surface of the printing head unit 110 is Side A, and the reverse is Side B, regardless of whether images are formed or not.

TABLE 1

| | | Discharge Order | Side A |
|---|---|---|---|
| Printing Side Up | Straight Discharge | From N-th Document | Side of Printing Sheet with Small Document Number |
| | Inversion Discharge | From N-th Document | Side of Printing Sheet with Large Document Number |
| Printing Side Down | Straight Discharge | From 1st Document | Side of Printing Sheet with Small Document Number |
| | Inversion Discharge | From 1st Document | Side of Printing Sheet with Large Document Number |

Table 1 shows a relationship between the discharging order of sheets and the side of the sheets corresponding to Side A. In this case, the sheets are numbered with the first, second, third, . . . , and the N-th in descending order. A plurality of documents (numbered with "1", "2", "3", . . . ) are assigned to the both sides of the sheets in the order from the first sheet to the N-th sheet.

TABLE 2

| Circulation Number and Printing Status of Each Side | | | First | Switch Back | | Switch Back |
|---|---|---|---|---|---|---|
| Side A | Side B | Circulation Number | Printing Side | in First Circulation | Second Printing | in Second Circulation |
| No Printing | No Printing | 0 | No | No | No | No |
| a(a ≧ 0, printed) | No Printing | a | Side A | No | No | No |
| a | b(a > b, a ≧ 2) | a | Side A | Yes | Side B | Yes |
| 1 | 0(printing) | 2 | Side B | Yes | Side A | No |
| 1 | 0(printing) | 2 | Side A | Yes | Side B | Yes |
| No Printing | b(b ≧ 1) | b | Side B | Yes | No | No |
| No Printing | 0(printing) | 1 | Side B | Yes | No | No |
| a | b(a < b, b ≧ 1) | b | Side B | Yes | Side A | Yes |
| a(a ≧ 0, printed) | b(a = b) | a + 1(=b + 1) | Side B | Yes | Side A | No |

The control condition is determined based on the Mowing conditions:

Which is printed first, the front side or the reverse side?

Which timing is used for inversion?

Which image is to be printed after how many circulations?

Table 2 shows a method of printing and reverse controlling, and shows a relationship between the circulation numbers, printing status in each side, and the total circulation number for each sheet. In this case, it is assumed that the circulation number necessary to decurl on Side A is a, and the circulation number necessary to decurl on Side B is b.

TABLE 3

| | | b | | | |
|---|---|---|---|---|---|
| | | No Printing | 0 | 1 | 2 or more |
| a | No Printing | 0 | 1(b + 1) | 1(b) | b |
| | 0 | 0(a) | 1(a + 1(=b + 1)) | 1(b) | b |
| | 1 | 1(a) | 2(a + 1 (=b + 2))(*1) | 2(a + 1(=b + 1)) | b |
| | 2 or more | a | a | a | When a ≠ b, larger number of a or b; When a = b, a + 1(= b + 1) |

(*1)Note that there are two ways when a = 1 and b = 0.

Table 3 shows a relationship between the circulation numbers for Side A and Side B and the total circulation number. The determination which side of Side A or Side B is printed first is also based on the relationship. In Table 3, Italic characters or numbers denote cases with printing on Side A first and Bold characters or numbers denote the opposite cases with printing on Side B first.

TABLE 4

| | Passed Sheet | | | | | | | | | |
|---|---|---|---|---|---|---|---|---|---|---|
| | 1 | 2 | 3 | 4 | 5 | 6 | 7 | 8 | 9 | 10 |
| Circulation Number of Side A | 2 | 0 | 2 | 2 | 0 | 1 | 1 | 1 | 1 | 1 |
| Circulation Number of Side B | 1 | 2 | 2 | 0 | 2 | 1 | 0(*2) | 2 | 1 | 0(*2) |
| Total Circulation Number | 2 | 2 | 3 | 2 | 2 | 2 | 1 | 2 | 2 | 1 |

(*2)Note that these values "0" denote the circulation number in cases without printing on Side B.

Table 4 shows an example of a calculation result regarding the circulation numbers of Side A and Side B of each passed sheet and the total circulation number of each passed sheet in 10 sheets of passed sheets (corresponding to printed sheets of 10 documents). The passed sheets are numbered in ascending order from the first discharging sheet. In addition, the number of sheets possible to be circulated on the circulation route CR is determined up to five, and a circulation cycle has five unit times. Further, the transfer spaces are numbered from 1 to 5.

Next, the sheet transfer schedule is coordinated based on the determined circulation numbers (S103). FIGS. 9A to 9F show the coordination steps for a sheet transfer schedule under the condition shown in Table 4. In FIGS. 9A to 9F, the lateral axis represents the transfer spaces included in one cycle and the vertical axis represents cycle numbers, and the relationship between the transfer spaces and the cycle numbers are described in a matrix form.

Then, the transfer timing numbers are numbered in ascending order as a sequence of natural numbers with respect to a unit time determining the transfer timing of the passed sheets "1" to "10" as a measure. The transfer timing numbers in Table 5 are "1" to "32". Also, each of the transfer spaces "1" to "5" is assigned with the passed sheets "1" to "10" (S201 in FIG. 4B).

Figure 9A:
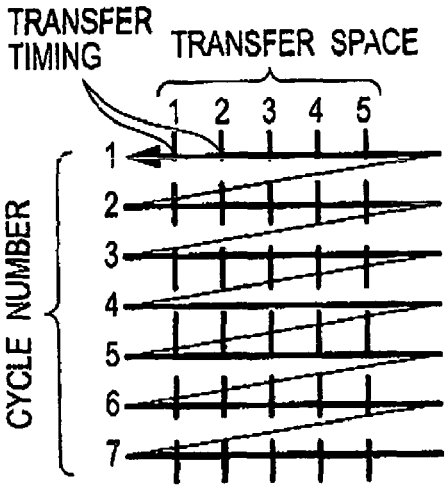
FIGS. 9A to 9F are views showing another example of coordination process of a sheet transfer schedule described in a matrix form in the printing apparatus shown in FIG. 1.
Figure 9B:
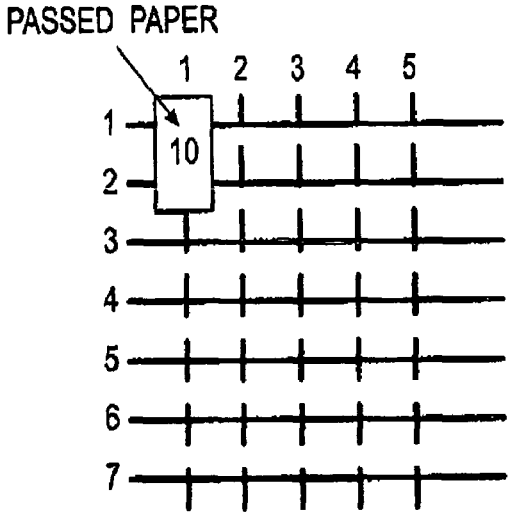
Figure 9C:
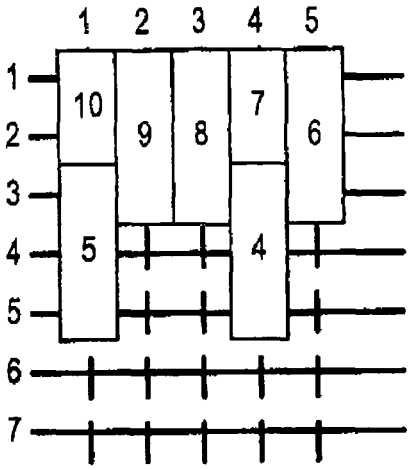
Figure 9D:
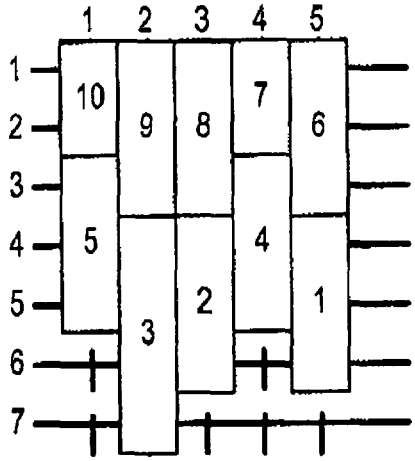

In particular, as shown in FIGS. 9B to 9D, the transfer spaces "1" to "5" are assigned with the passed sheets "1" to "10" in descending order from the larger number according to the circulation numbers determined as shown in Table 4, and the time that the transfer spaces "1" to "5" are occupied by the passed sheets is scheduled. In this case, the empty transfer timing numbers between the already assigned transfer timing numbers are also assigned with the rest numbers of the passed sheets in descending order from the larger number. In other words, the empty transfer timing numbers are searched sequentially by slapping the already assigned transfer timing numbers, and then the searched transfer timing numbers are assigned with the rest numbers of the passed sheets.

Figure 9E:
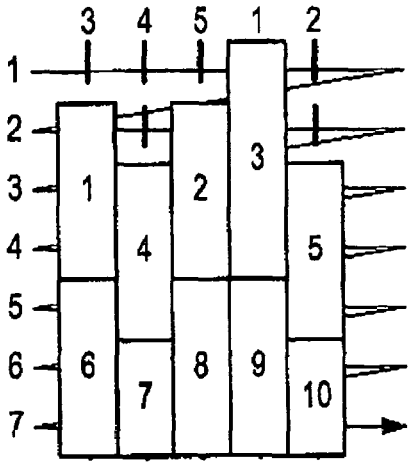
Figure 9F:
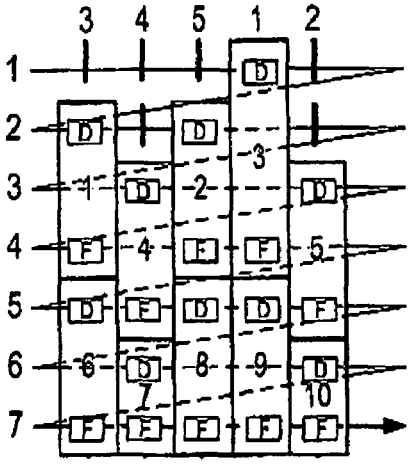

After the assignment of the transfer timing numbers is completed with respect to all the passed sheets, the transfer timing numbers (and the transfer space numbers) are renumbered in the reverse order (FIG. 9E). Then, as shown in FIG. 9F, the largest transfer timing number is defined as discharge timing of each passed sheet, and the smallest transfer timing number is defined as feed timing of each passed sheet in the renumbered transfer timing numbers (S203 in FIG. 4B). The results are shown in Tables 5 and 6.

TABLE 5

| | Transfer Timing Number | | | | | | | | |
|---|---|---|---|---|---|---|---|---|---|
| | 32 | 31 | 30 | 29 | 28 | 27 | 26 | 25 | 24 |
| Passed Sheet Status | 10 | 9 | 8 | 7 | 6 | 10 | 9 | 8 | 7 |
| | D | D | D | D | D | F | | | D |
| | 23 | 22 | 21 | 20 | 19 | 18 | 17 | 16 | 15 |
| | 6 | 5 | 9 | 8 | 4 | 6 | 5 | 3 | 2 |
| | | D | F | F | D | F | | D | D |
| | 14 | 13 | 12 | 11 | 10 | 9 | 8 | 7 | 6 |
| | 4 | 1 | 5 | 3 | 2 | 4 | 1 | | 3 |
| | | D | F | | | F | | | |
| | 5 | 4 | 3 | | 1 | | | | |
| | 2 | | 1 | | 3 | | | | |
| | F | | F | | F | | | | |

Here, the symbol "D" denotes "Sheet Discharging Process" and the symbol "F" denotes "Sheet Feeding Process".

TABLE 6

| | Passed Sheet | | | | | | | | | |
|---|---|---|---|---|---|---|---|---|---|---|
| | 1 | 2 | 3 | 4 | 5 | 6 | 7 | 8 | 9 | 10 |
| Circulation Number of Side A | 2 | 0 | 2 | 2 | 0 | 1 | 1 | 1 | 1 | 1 |
| Circulation Number of Side B | 1 | 2 | 2 | 0 | 2 | 1 | 0(*3) | 2 | 1 | 0(*3) |
| Total Circulation Number | 1 | 2 | 3 | 2 | 2 | 2 | 1 | 2 | 2 | 1 |
| Sheet Feed Timing | 2 | 4 | 0 | 8 | 11 | 17 | 23 | 19 | 20 | 26 |
| Sheet Discharge Timing | 12 | 14 | 15 | 18 | 21 | 27 | 28 | 29 | 30 | 31 |

(*3)Note that the value "0" denotes the circulation number in cases without printing on Side B.

FIG. 6B represents the contents of Table 6 in a diagram form, and FIG. 6A represents a conventional sheet transfer schedule under the conditions of the present embodiment. Table 6 shows that the passed paper "3" has the maximum value "3" in the total circulation number necessary to dry the both sides. Therefore, in the conventional sheet transfer schedule show in FIG. 6A, all the passed papers must be circulated three times. As a result, it turns out the above-mentioned sheet transfer schedule coordinated by the scheduling coordinator 335 can shorten the total elapsed time by "8" unit times (=41-33) in comparison with the conventional sheet transfer schedule.

According to the sheet transfer schedule, the printing is started (S104 in FIG. 4A), every sheet is circulated predetermined times, and then the printing is finished.

(Effects)

As described above, in the present embodiment, the printing rate of each document is detected, and the sheet transfer schedule to circulate each sheet predetermined times depending on the printing rate of each document is coordinated based on the ejecting amount of ink or the concentration of ink necessary to print each document on a sheet. Therefore, it is possible to prevent from circulating sheets unnecessary to decurl, and avoid the total printing time taking longer. While, the times during transferring sheets from feeding to discharging are different from each sheet since the circulation numbers enough to decurl are determined for each sheet. However, the fundamental printing order of the sheets can be maintained even if each sheet is circulated a predetermined number of times and the sheets are discharged in the order of decurling since it is possible to control the order and timing of feeding sheets based on the sheet transfer schedule coordinated as described above.

In particular, in the present embodiment the scheduling coordinator 335 coordinates the sheet transfer schedule based on the feed timing of each sheet obtained by subtracting the circulation time required for each sheet to circulate in the circulation route CR with the circulation number determined for each document by the circulation number determiner 332*b* from the sheet discharge timing of each sheet (in other words, the sheet discharge timing is determined in advance, and the sheet feed timing is determined by calculating back from the sheet discharge timing). Thus, it is possible to conform the order of the sheets to be circulated the predetermined number of times to the order of the sheets to be discharged, and maintain productivity of printing avoiding unnecessary circulations.

Further, in the present embodiment the scheduling coordinator 335 calculates the number of sheets possible to be circulated on the circulation route, defines the time obtained by dividing the time required for each sheet to take a round on the circulation route by the number of sheets possible to be circulated as a unit time, sets the sequence of natural numbers in the unit time as a measure as temporary transfer timing numbers, assigns the sequence of natural numbers modulo the number of sheets possible to be circulated to the temporary transfer timing numbers as a number of spaces on the circulation route for transferring each sheet, assigns each sheet to the respective spaces in descending order from a sheet to be last discharged, changes the order of the temporary transfer timing numbers in reverse, assigns the respective reversed numbers to each sheet as true transfer timing numbers, and determines the transfer timing with the largest number as the discharge timing of each sheet and the transfer timing with the smallest number as the feed timing of each sheet in the true transfer timing numbers assigned to each sheet.

In addition, in the present embodiment, the sheet transfer schedule is coordinated so that the front-side printing and the reverse-side printing are simultaneously performed by inserting a sheet inverted via the inversion route CR between two sheets to be printed on the front sides. Thus, it is possible to perform the adequate decurl process while improving productivity of printing at both-side printing.

Moreover, in the present embodiment, the transfer drive controller controls the driving mechanisms on the sheet transfer route so as to conform the circulation time of a sheet fed from the system of feeding routes FR to the recirculation time of a sheet received from the circulation route CR. Thus, it is possible that the unit time of the newly fed sheet and the unit time of the circulating sheet are dealt with equally, and the coordination process of the sheet transfer schedule is simplified so as to speed up processing.

MODIFIED EXAMPLE

Figure 10:
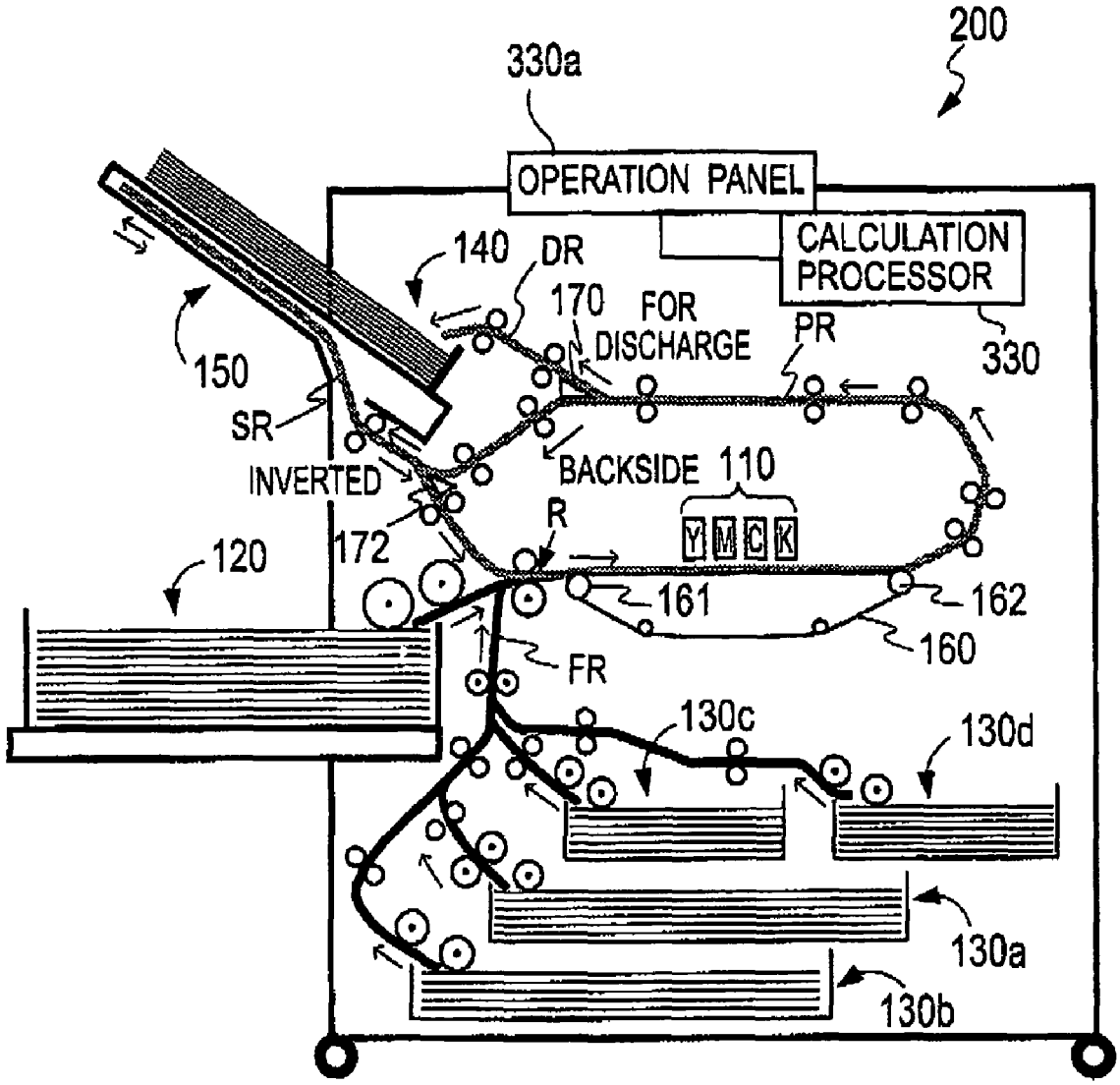
FIG. 10 is a view showing a schematic structure of a modified example of the printing apparatus shown in FIG. 1.

Next, there will be described below a modified example of the printing apparatus 100 according to the above-mentioned embodiment. FIG. 10 is a schematic view showing a printing sheet transfer route of a printing apparatus 200 according to the modified example. In the figure, common elements are indicated with the same reference numerals as the above-mentioned embodiment. In addition, the common elements have the common functions unless otherwise specified, and the repetitive explanations are omitted.

The printing apparatus 200 does not include the bypass route BR that one of the elements of the printing apparatus 100. Therefore, sheets are always inverted when being recirculated.

In other words, as shown in FIG. 10, the sheets are consistently introduced to the inversion route SR from the normal transfer route PR in the printing apparatus 200.

The whole printing process in the printing apparatus 200 is performed in the same process shown in FIG. 4A as the above-mentioned embodiment Also, the coordination process of a sheet transfer schedule is performed bin the same process shown in FIG. 4B.

Specifically, as shown in FIG. 4A, when image data is obtained by receiving job data and the like, image data development by the image processor 331 and a color conversion by the color conversion circuit 331*b* are performed. Also, a detection of printing rates are reformed based on print images (S101). Then, the printing rates of the print images are evaluated step by step whether each of the printing rates is over a threshold value, and the circulation numbers of each sheet are determined according to the printing rates respectively (S102). The threshold value is appropriately altered according to the degree of sheet dryness (based on moisture and transmittance) obtained by the desiccation detector 336*a*.

Figure 11:
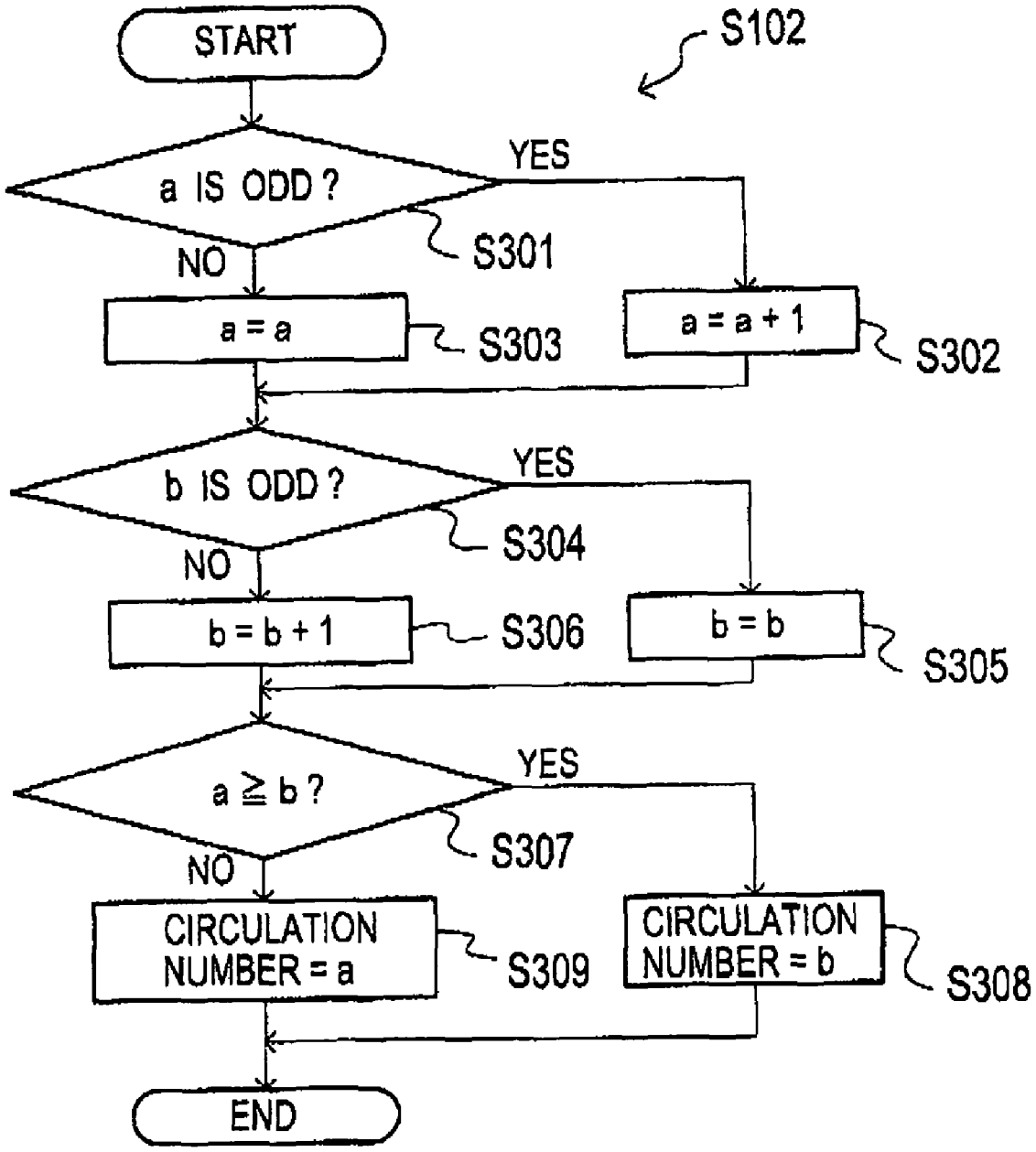
FIG. 11 is a flow chart showing determination process of circulation numbers in the printing apparatus shown in FIG. 10.

The determination of the circulation numbers in Step S102 is made by the step shown in FIG. 11. Similarly in the modified example, when a sheet passes through the printing head unit 110 before being discharged, a side of the sheet opposed to the printing head unit 110 is Side A, and the reverse is Side B, regardless of whether images are formed or not. In addition, the circulation number necessary to decurl on Side A is a, and the circulation number necessary to decurl on Side B is b.

In the sheet discharging step, the side possible to print is Side A. Then, the side possible to print is alternated between Side B and Side A as the steps are back to the start. Actually, a series of these steps is to be "Sheet feeding step→ . . . →B→A→B→A→B→A (Sheet discharging step)". Thus, Side B can be printed at the odd number step(s) before the sheet discharging step, and Side A can be printed at the even number steps before the sheet discharging step.

In the modified example, the determination of the circulation numbers is made in view of these printing sides. Specifically, In cases without printing on Side B and Side A, or cases without printing on Side B and with the circulation number for Side A being "0", circulation numbers necessary for Side A and Side B are "0", respectively. In other cases, the printing step on Side A is necessary to be performed at more than "a" step(s) before the sheet discharging step, and the required number is determined depending on whether "a" is odd or not. When the circulation number "a" is odd ("Y" in S301), only Side B is possible to be printed at "a" step(s) before discharging. Therefore, the circulation number of the sheet is "a+1" (S302), and the sheet is discharged after "a+1" circulations from the printing timing. While, when the circulation number "a" is even ("N" in S301), the circulation number of the sheet is "a" (S303), and the sheet is discharged after "a" circulations from the print timing.

Then, the printing step on Side B is necessary to be performed at more than "b" step(s) before the sheet discharging step. There is one circulation difference from the printing step on Side A. Therefore, the circulation number of the sheet is "b" (S305) when the circulation number "b" is odd ("Y" in S304), and the circulation number of the sheet is "b+1" (S306) when the circulation number is even ("N" in S304).

Thus, the calculated circulation numbers "a" and "b" on each Side A and Side B of the sheet are compared with one another, and the larger number is determined as the circulation number of the sheet (S307 to S309).

Next, the sheet transfer schedule is coordinated based on the determined circulation numbers (S103). FIGS. 9A to 9F show the preparation steps for scheduling. The relationship between the transfer spaces and the cycle numbers in FIGS. 9A to 9F are described in a matrix form. The lateral axis represents the transfer spaces "1" to "5" included in one cycle, and the vertical axis represents the cycle numbers. Then, the transfer timing numbers are numbered in ascending order as a sequence of natural numbers with respect to a unit time to determine the transfer timing of the passed sheets "1" to "10". The transfer timing numbers in Table 5 are "1" to "32". Also, each of the transfer spaces "1" to "5" is assigned with the passed sheets "1" to "10" (S201 in FIG. 4B).

Specifically, as shown in FIGS. 9B to 9D, each of the transfer spaces "1" to "5" is assigned with the passed sheets "1" to "10" respectively in descending order from the larger number according to the circulation numbers determined as shown in Table 4, and the time that the transfer spaces "1" to "5" are occupied by the passed sheets is calculated for scheduling. In this case, the empty transfer timing numbers between the already assigned transfer timing numbers are also assigned with the rest numbers of the passed sheets in descending order from the larger number. In other words, the empty transfer timing numbers are searched sequentially by skipping the already assigned transfer timing numbers, and that the searched transfer timing numbers are assigned with the rest numbers of the passed sheets.

After the assignment is completed with respect to all the sheets, the transfer timing numbers (and the numbers of transfer spaces) are renumbered in the reverse order (FIG. 9E). Then, as shown in FIG. 9F, the largest transfer timing number is defined as a discharge timing of each passed sheet, and the smallest transfer timing number is defined as a feed timing of each passed sheet in the renumbered transfer timing numbers (S203 in FIG. 4B).

According to the coordinated sheet transfer schedule, the printing is started (S104 in FIG. 4A), every sheet is circulated predetermined times, and then the printing is finished.

According to the present invention as described above, in the printing apparatus such as an ink-jet printer at decurling printed sheets using a circulation route, it is possible to minimize the circulation numbers, avoid the total printing time taking longer, and maintain productivity by determining the circulation numbers of each sheet according to the printing rates of each document The invention is not limited to the embodiment described above and modifications may become apparent to these skilled in the art, in light of the teachings herein.

This application is based upon the Japanese Patent Application No. 2008-176331, filed on Jul. 4, 2008, the entire content of which is incorporated by reference herein.

What is claimed is:

1. A printing apparatus comprising:

an image former that forms a plurality of images included in a single print job on a plurality of sheets;

a circulation transfer route composed of a first transfer route that transfers each sheet fed from a sheet feeding route toward a sheet discharging route, and a second transfer route that is branched from the first transfer route and returns each sheet received from the first transfer route to the first transfer route;

a printing rate detector that analyzes an ejecting amount of ink or a concentration of ink necessary to form each image on each sheet by the image former on the first transfer route and detects a printing rate of each image to be printed from image data;

a circulation number determiner that determines a circulation number for each sheet necessary to decurl each sheet on the circulation transfer route based on the printing rate of each image;

a scheduling coordinator that coordinates a sheet transfer schedule describing a forming speed of each image, a transfer speed of each sheet, a transfer order of each sheet, a feed timing of each sheet, a transfer timing of each sheet, a discharge timing of each sheet, and an assignment of blank spaces for decurl, based on the circulation numbers of each sheet; and a transfer drive controller that controls the forming speed of each image, the transfer speed of each sheet, the transfer order of each sheet, the feed timing of each sheet, the transfer timing of each sheet, and the discharge timing of each sheet, by controlling driving mechanisms provided on the circulation transfer route and switching between the first transfer route and the second transfer route based on the sheet transfer schedule, wherein the scheduling coordinator coordinates the sheet transfer schedule based on the feed timing of each sheet obtained by subtracting a circulation time required for each sheet to circulate on the circulation transfer route with the circulation number assigned to each sheet from the discharge timing of each sheet.

2. The printing apparatus according to claim 1, wherein the scheduling coordinator coordinates the sheet transfer schedule by calculating a number of sheets possible to be circulated on the circulation transfer route, defining a time obtained by dividing a time required for each sheet to take a round on the circulation transfer route by the number of sheets possible to be circulated as a unit time, setting a sequence of natural numbers in the unit time as a measure as temporary transfer timing numbers, assigning the sequence of natural numbers modulo the number of sheets possible to be circulated to the temporary transfer timing numbers as a number of spaces on the circulation transfer route for transferring each sheet, assigning each sheet to the respective spaces in descending order from a sheet to be last discharged, changing an order of the temporary transfer tuning numbers in reverse, assigning the respective reversed numbers to each sheet as true transfer timing numbers, and determining transfer timing with a largest number as discharge timing of each sheet and transfer timing with a smallest number as feed timing of each sheet in the true transfer timing numbers assigned to each sheet.

3. The printing apparatus according to claim 1,wherein the second transfer route includes an inversion route that is branched from the first transfer route, inverts both sides of each sheet received from the first transfer route, and returns to me first transfer route, the scheduling coordinator further describes inversion of a sheet, an image-forming speed with respect to an inverted sheet, and transfer timing of the inverted sheet provided with an image to the sheet transfer schedule, and the transfer drive controller controls the inversion of a sheet, the image-forming speed with respect to the inverted sheet, and the transfer timing of the inversed sheet provided with the image based on the sheet transfer schedule.

4. The printing apparatus according to claim 1,wherein the transfer drive controller controls the driving mechanisms on the circulation transfer route so as to conform a circulation time of a sheet fed from the sheet feeding route to a recirculation time of a sheet received from the circulation transfer route.

5. A printing method, comprising:

preparing a printing apparatus that includes a circulation transfer route composed of a first transfer route that transfers each sheet fed from a sheet feeding route toward a sheet discharging route, a second transfer route that is branched from the first transfer route and returns each sheet received from the first transfer route to the first transfer route, and a image former that forms a;

analyzing an ejecting amount of ink or a concentration of ink necessary to form each image on each sheet by the image former on the first transfer route and detecting a printing rate of each image to be printed from image data;

determining a circulation number for each sheet necessary to decurl each sheet on the circulation transfer route based on the printing rate of each image;

coordinating a sheet transfer schedule describing a forming speed of each image, a transfer speed of each sheet, a transfer order of each sheet, a feed timing of each sheet, a transfer timing of each sheet, a discharge timing of each sheet, and an assignment of blank spaces for decurl, based on the circulation number of each sheet; and controlling the forming speed of each image, the transfer speed of each sheet, the transfer order of each sheet, the feed timing of each sheet, the transfer timing of each sheet, and the discharge timing of each sheet, by controlling driving mechanisms provided on the circulation transfer route and switching between the first transfer route and the second transfer route based on the sheet transfer schedule, wherein the sheet transfer schedule is coordinated based on the feed timing of each sheet obtained by subtracting a circulation time required for each sheet to circulate on the circulation transfer route with the circulation number assigned to each sheet from the discharge timing of each sheet.

6. The printing method according to claim 5, wherein the sheet transfer schedule is coordinated by calculating a number of sheets possible to be circulated on the circulation transfer route, defining a time obtained by dividing a time required for each sheet to take a round on the circulation transfer route by the number of sheets possible to be circulated as a unit time, setting a sequence of natural numbers in the unit time as a measure as temporary transfer timing numbers, assigning the sequence of natural numbers modulo the number of sheets possible to be circulated to the temporary transfer timing numbers as a number of spaces on the circulation route for transferring each sheet, assigning each sheet to the respective spaces in descending order from a sheet to be last discharged, changing an order of the temporary transfer timing number in reverse, assigning the respective reversed numbers to each sheet as true transfer timing numbers, and determining transfer timing with a largest number as discharge timing of each sheet and transfer timing with a smallest number as feed timing of each sheet in the true transfer timing numbers assigned to each sheet.

7. The printing method according to claim 5, wherein the second transfer route includes an inversion route that is branched from the first transfer route, inverts both sides of each sheet received from the first transfer route, and returns to the first transfer route, inversion of a sheet, an image-forming speed with respect to an inverted sheet, and transfer timing of the inverted sheet provided with an image are further described to the sheet transfer schedule, and the inversion of a sheet, the image-forming speed with respect to the inverted sheet, and the transfer timing of the inverted sheet provided with the image are controlled based on the sheet transfer schedule.

8. The printing method according to claim 5, wherein the driving mechanisms on the circulation transfer route are controlled so as to conform a circulation time of a sheet fed from the sheet feeding route to a recirculation time of a sheet received from the circulation transfer route.

9. The printing apparatus according to claim 1, wherein the second transfer route includes an inversion route that is branched from the first transfer route, inverts both sides of each sheet received from the first transfer route, and returns to the first transfer route, and wherein the scheduling coordinator further describes a printing sequence of a sheet and an inverted sheet in the sheet transfer schedule, based on the circulation numbers of each sheet.

10. The printing method according to claim 5, wherein the second transfer route includes an inversion route that is branched from the first transfer route, inverts both sides of each sheet received from the first transfer route, and returns to the first transfer route, and wherein the scheduling coordinator further describes a printing sequence of a sheet and an inverted sheet in the sheet transfer schedule, based on the circulation numbers of each sheet.

11. The printing apparatus according to claim 1, further comprising:

a desiccation detector that detects a drying condition of each sheet and changes the determined circulation number when a sheet is dried before completing the predetermined circulation number.

12. The printing method according to claim 5, further comprising:

detecting a drying condition of each sheet and changing the determined circulation number when a sheet is dried before completing the predetermined circulation number.

* * * * *